United States Patent [19]

Pastva

[11] Patent Number: 4,641,865

[45] Date of Patent: Feb. 10, 1987

[54] CLOSURE CONTROL MECHANISM

[75] Inventor: John V. Pastva, Parma Heights, Ohio

[73] Assignee: The Eastern Company, Cleveland, Ohio

[21] Appl. No.: 762,018

[22] Filed: Aug. 1, 1985

Related U.S. Application Data

[63] Continuation of Ser. No. 431,713, Sep. 2, 1982, abandoned.

[51] Int. Cl.[4] ..... E05C 9/04

[52] U.S. Cl. ..... 292/5; 292/DIG. 27; 292/DIG. 57

[58] Field of Search ..... 292/DIG. 57, 167, 5, 292/DIG. 49, DIG. 27, 169.18, 252, 5, 7, 34, 37; 70/223

[56] References Cited

U.S. PATENT DOCUMENTS

| | | | |
|---|---|---|---|
| 1,658,903 | 2/1928 | Roedding | 292/DIG. 71 |
| 2,126,995 | 8/1938 | Kingdon | 292/36 X |
| 2,274,404 | 2/1942 | Flaherty | 292/DIG. 57 |
| 2,349,301 | 5/1944 | Overby | 292/DIG. 57 |
| 2,469,601 | 5/1949 | Lee | 292/DIG. 27 |
| 2,497,329 | 2/1950 | Smith et al. | 292/DIG. 27 |
| 2,735,706 | 2/1956 | Pelcin | 292/34 |
| 3,333,878 | 8/1967 | Pelcin | 292/37 |
| 3,953,061 | 4/1976 | Hansen et al. | 292/5 |
| 4,188,054 | 2/1980 | LaMarca | 292/DIG. 49 X |
| 4,366,974 | 1/1983 | Horgan, Jr. | 292/336.3 |

FOREIGN PATENT DOCUMENTS

| | | | |
|---|---|---|---|
| 1545047 | 5/1979 | United Kingdom | 292/DIG. 49 |

OTHER PUBLICATIONS

Eberhard Mfg. Co. Catalog, pp. 13–16, 20, Section 2, pp. 10–12, Section 8, 1978.

*Primary Examiner*—Richard E. Moore

*Attorney, Agent, or Firm*—Watts, Hoffmann, Fisher & Heinke

[57] ABSTRACT

A multi-point closure control mechanism or lock especially designed for use with rear and/or side doors of a closed body highway truck, particularly a so-called panel truck, and for use with doors of military vehicles. The closure control mechanism comprises two dead bolts, slidably supported in suitable brackets adjacent to the upper and lower edges of a door near its free vertical edge, that engage keepers or catches in the form of plates on the vehicle body. Each bolt has a free running roller therein to facilitate entrance and retraction of the bolt into and out of engagement with its respective keeper or catch. The dead bolts are connected by rod members to pivots eccentrically located on a lock operating member rotatable in a frame member fixed to the door intermediate the bolts. The operating member also includes a cylindrical rod-like projection extending normal to the free edge of the door when the bolts are engaged with their keepers or catches at the top and bottom of the door. The rod-like projection has a roller to facilitate its engagement with and release from a keeper or catch. One embodiment of the aperture member has a mechanism for selectively disabling an outside handle connected to the mechanism.

6 Claims, 4 Drawing Figures

CLOSURE CONTROL MECHANISM

This application is a continuation of application Ser. No. 431,713, filed Sept. 2, 1982, now abandoned.

TECHNICAL FIELD

The invention relates to manually operable closure control mechanism or locks comprising one or more dead bolts especially adapted for use with doors of closed body highway trucks.

BACKGROUND ART

Multi-point closure control mechanism or locks for doors of closed body highway trucks including so-called panel trucks which include dead bolts at the upper and/or lower edges of the door engageable in keepers or catches on the truck body and operated by rods connected to pivots eccentrically located on a manually rotatable member are known but in many instances, due to misalignment of the doors and/or seals employed around the doors, etc., the operating mechanism for the bolts fails in operation because of the resistance of the bolts to proper engagement in their respective keepers.

A typical prior art closure control mechanism or lock of the character referred to is disclosed in U.S. Pat. No. 3,333,878.

DISCLOSURE OF INVENTION

The present invention provides a novel and improved closure control mechanism or lock especially designed for use with doors of closed body highway trucks, which mechanism includes one or more dead bolts adapted for installation on a door adjacent to a free edge thereof and having a dead bolt at the top and/or bottom edge of the door engageable with keepers or catches on the truck body and provided with rollers for facilitating extension and retraction of the bolt or bolts relative to their respective keeper or keepers. The bolt or bolts are extended relative to and retracted from their respective keepers by a rod like member or members connected thereto and to a pivot or pivots on a manually rotatable lock operating member carried by a bracket or frame adapted for installation on the door intermediate the upper and lower edges thereof. The pivot or pivots on the lock operating member to which the bolt operating rod or rods are connected are eccentric to its axis of rotation.

A further aspect of the invention is the provision of a shaft-like extension on the rotatable lock actuating or operating member adapted to engage a keeper on the truck body and having a roller thereon to facilitate engagement and disengagement thereof with its respective keeper.

A further aspect of the invention is the provision of handles located on the inside and the outside of a door and a mechanism by which the outside handle can be disabled from the inside and the bolts operated by the inside handle without rotation of the outside handle.

The invention resides in the novel constructions and combinations and arrangements of the parts of the lock which accounts for its simplicity of construction and its reliability and ease of operation and further features and advantages will be herein referred to or will become apparent to those skilled in the art to which the invention pertains from the following description of the preferred embodiment depicted in the accompanying drawings.

BEST MODE FOR CARRYING OUT THE INVENTION

Figure 1:
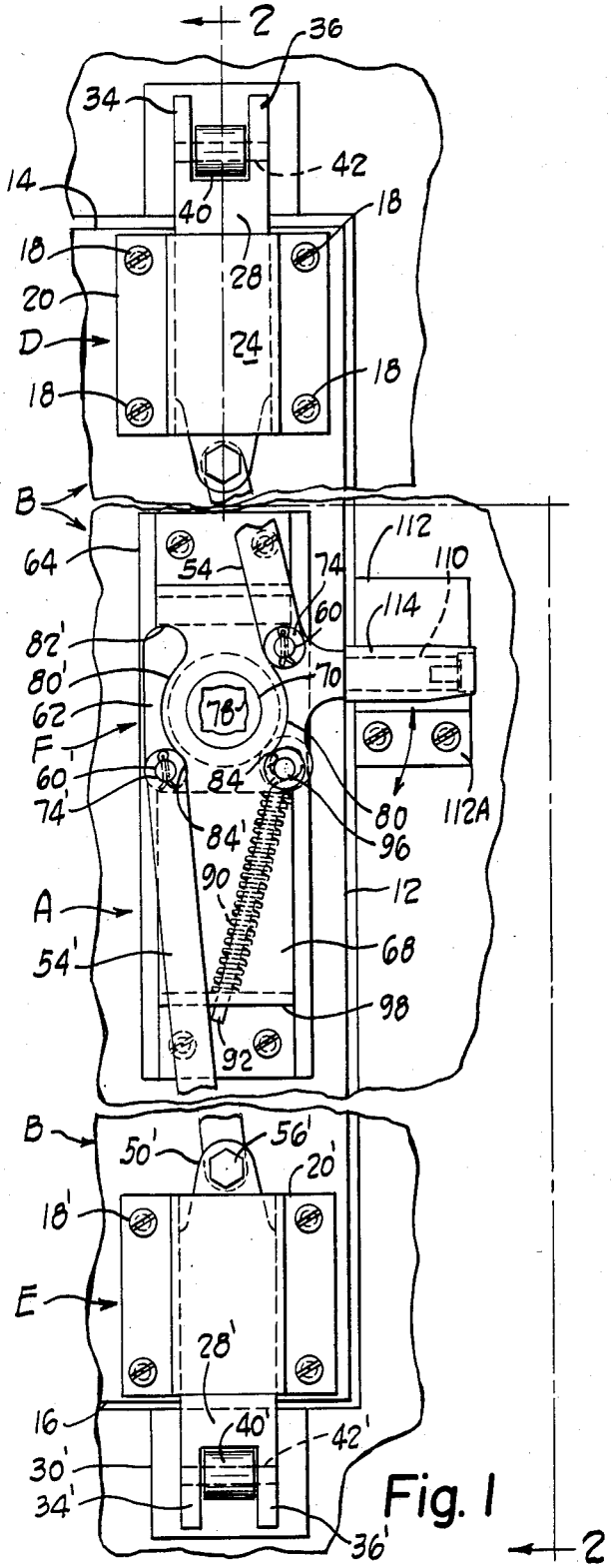
FIG. 1 is a fragmentary, elevational view of a closed body highway truck having a lock embodying the present invention assembled therewith.
Figure 2:
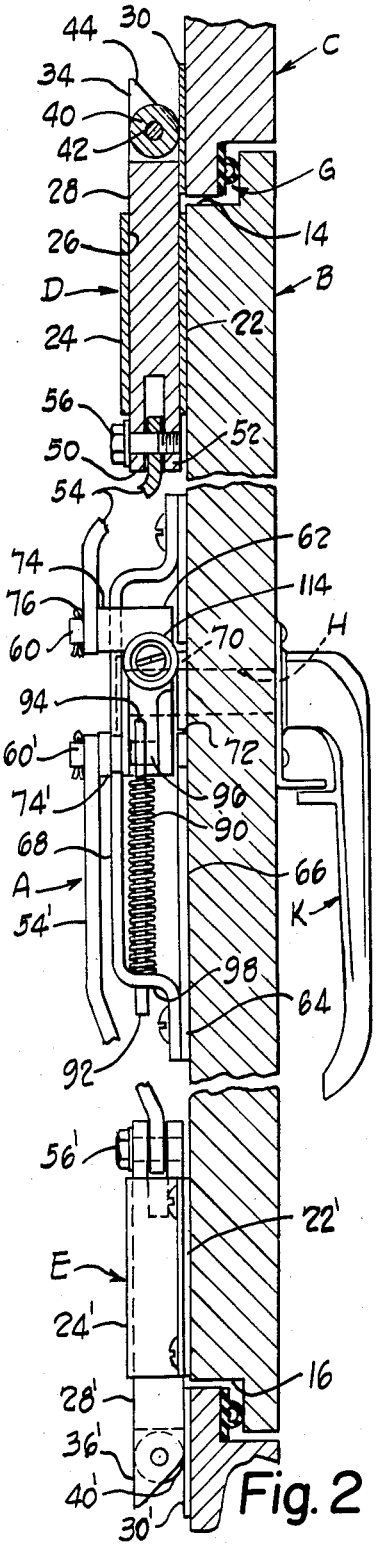
FIG. 2 is a fragmentary sectional view approximately on the line 2—2 of FIG. 1 looking in the direction of the arrows.

Although the closure control mechanism of the present invention, designated generally by the reference character A, can be otherwise employed, it is herein depicted and described as connected to the inside of a pivoted door B of a closed body highway truck, the body of which is designated generally by the reference character C. The door B opens outwardly and is hinged at its left hand vertical side, as viewed in FIG. 1, to the truck body C. It is to be understood, however, that the closure control mechanism A is equally applicable to either right or left hand doors. Closure control mechanisms of the type to which the invention relates are typically referred to in the trade to which it relates as a "lock" and the closure control mechanism depicted in the drawings and herein described will be hereinafter sometimes referred to as a lock. The reference character G designates a soft gasket around the door opening in the truck body C against which the door B closes.

The closure control mechanism or lock A comprises top and bottom dead bolt assemblies D, E which are duplicates of one another and are connected to the inside of the door B adjacent to its free vertical edge 12 and its non-pivoted upper and lower horizontal edges 14, 16 by headed and threaded fasteners indicated by the reference character 18. Since the bolt assemblies D, E are duplicates, only the upper assembly D will be herein described in detail and the duplicate parts of assembly E will be designated by the same reference characters with a prime mark affixed thereto.

The bolt assembly D includes a frame or bolt supporting bracket 20 comprising a base plate 22 and a channeled top or cover plate 24 equal in size to the plate 22, as viewed in elevation, connected together and to the door B by the fasteners 18. The plates 22, 24 form therebetween an aperture 26 in which a dead bolt 28 is slidably supported with at least one end, which in the case of the bolt 28 is the upper end thereof, projecting from the bracket 20 in the direction of the adjacent horizontal edge of the door B. This upper end of the bolt 28 which is the end that engages a keeper or catch in the form of a plate 30 connected to the adjacent structure of the door opening of the truck body C, is bifurcated, providing two tines 34, 36 between which a roller 40 is rotatably supported on a pin 42. The end of the bolt 28 is tapered as at 44 on the side thereof facing in the direction of the door. The roller 40 extends slightly beyond the side of the member in which it is supported facing the inner side of the door and is the part of the bolt which engages the keeper or catch 30, except for the tapered end 44 of the member 28 thereabove, as the bolt is moved to a locking position after the door is closed.

The lower end of the bolt 28, that is, the end facing in the direction away from the upper edge 14 of the door B, is also bifurcated, providing front and back tines 50, 52 between which the upper flattened end of a rod 54 for reciprocating the bolt 28 is pivoted on a headed and threaded fastener 56 the shank of which is threaded into a tapped aperture in the tine 52. The lower flattened end of the rod 54 is pivoted to an upstanding or forwardly extending stud or post 60 on a rotatable operating member 62 supported in a frame assembly 64 of a bolt operating structure or member designated generally by the reference character F. The stud 60 is eccentrically located with respect to the axis of rotation of the member 62.

The frame assembly 64 comprises a back plate 66 and a channel-like front or cover member 68 providing an aperture between the members 66, 68 in which the member 62 is rotatably supported by suitable means including a boss 70 on the rear side (adjacent the door) of the member 62 which is rotatably received in a circular aperture 72 in the plate 66. The stud or pivot pin 60 extends forwardly of the cover plate 68 and is provided with a roller 74 where it projects past the cover plate 68. One side of the lower end of the rod 54 abuts an end of the roller 74 and a cotter pin 76 in the end of the stud 60 engages the other side of the rod to maintain it assembled with the stud 60.

The rotatable member 62 is provided with a driving connection in the form of a square through-aperture 78 concentric with its axis of rotation for the reception and disengagement of a manual tool for oscillating the same to extend and retract the bolt 28. The tool for oscillating the member 62 may include a handle K fixed to the member 62, if desired. An aperture H in the door B in alignment with the aperture 78 allows insertion of a tool instead of the handle K for operation of the lock from the exterior of the vehicle. During oscillation of the member 62 the roller 74 rolls along an arcuate surface 80 on the side of the cover plate 68 which surface terminates in reverse bends or arcs 82, 84 that limit the travel of the roller 74 and in turn the extent of movement of the bolt 28.

The rotatable member 62 is resiliently held or biased to whichever of its limited positions to which it is manually moved by a compression spring 90 on the shank of an eye member 92 the eye 94 of which engages about a short stud or projection 96 on the member 62 located at one side of the vertical centerline through the frame assembly 64 and through which centerline the axis of rotation of the member 62 passes. The free end of the shank of the eye member 92 projects through an aperture in lower forwardly extending part 98 of the cover plate 68 the center of which aperture lies in the aforementioned centerline. The lower end of the spring abuts the part 98 of the cover plate 68 and the upper end abuts the member 62.

The lower bolt 28' is connected to the rotatable member 62 in the bolt operating assembly F by a rod 54' similar to the rod 54 and connected to the bolt 28' and a second stud or projection 60' on the member 62 in a manner similar to that in which the rod 54 is connected to the bolt 28 and to the stud 60 and the corresponding parts being designated by the same reference characters with a prime mark affixed thereto.

The studs or projections 60, 60' are located 180° from one another about the axis of rotation of the member 62 from which axis they are offset eccentrically a distance to effect the desired movement of the bolts 28, 28' in their supporting brackets. In operation of the lock, the roller 74' on the stud 60' travels along an arcuate surface 80' similar to the surface 80 and at the ends of its travel abuts reverse arcs 82', 84' in a manner similar to that in which the roller 74 abuts the arcs 82, 84. As the door is closed and the member 62 rotated to secure the door in closed position, the inclined ends 44, 44' first contact the striker plates 30, 30' and upon continuous rotation of the member 62 the rollers 40, 40' engage the plates and draw the door tightly closed compressing the gasket G. The plate-like keepers 30, 30' may be omitted if desired and the bolts 28, 28' allowed to engage directly parts of the truck body adjacent thereto. Alternately, one embodiment of the invention utilizes tapered plates similar to plates 30, 30' but that vary in thickness along their length, being relatively thin adjacent the door edge and thicker farther from the edge to form an incline so movement of the bolts into a locking position applies progressively more closing force as the rollers 40, 40' move up the inclines.

As another feature of the invention, the rotatable bolt actuating member 62 is further provided with a cam type bolt in the form of an arm 110 projecting from one side thereof in the direction away from and normal to the vertical free edge of the door for engagement with a keeper or catch 112 in the form of a plate fixed to the truck body C when the bolts 28, 28' are engaged with their respective keepers or catches 30, 30'. The free end of the arm 110 carries a roller sleeve 114 for engagement with the keeper 112 to facilitate its engagement and disengagement thereof with the keeper. One end **112*a* of the plate-like keeper 112 is inclined to provide a surface for the roller sleeve 114** to roll up upon and pull the door closed.

The lock A of the invention is herein shown and described as applied to the inside of an outwardly opening door B of a closed body highway truck, but it is equally applicable to various closure members even those that are not pivoted along one edge. The depicted lock, for example, can be applied to a door such as the door B but opening inwardly of the truck body by removing the bolts 28, 28' from their supporting brackets 20, 20', rotating the bolts 180° about their longitudinal axis and reassembling them with their supporting brackets. This would necessitate providing either surface mounted or recessed keepers or catches having apertures for the reception of the ends of the bolt or bolts. In the event the center bolt 110 is employed, a suitable keeper or catch would also be provided. Recessed keepers or catches are shown in U.S. Pat. No. 3,333,878.

Figure 3:
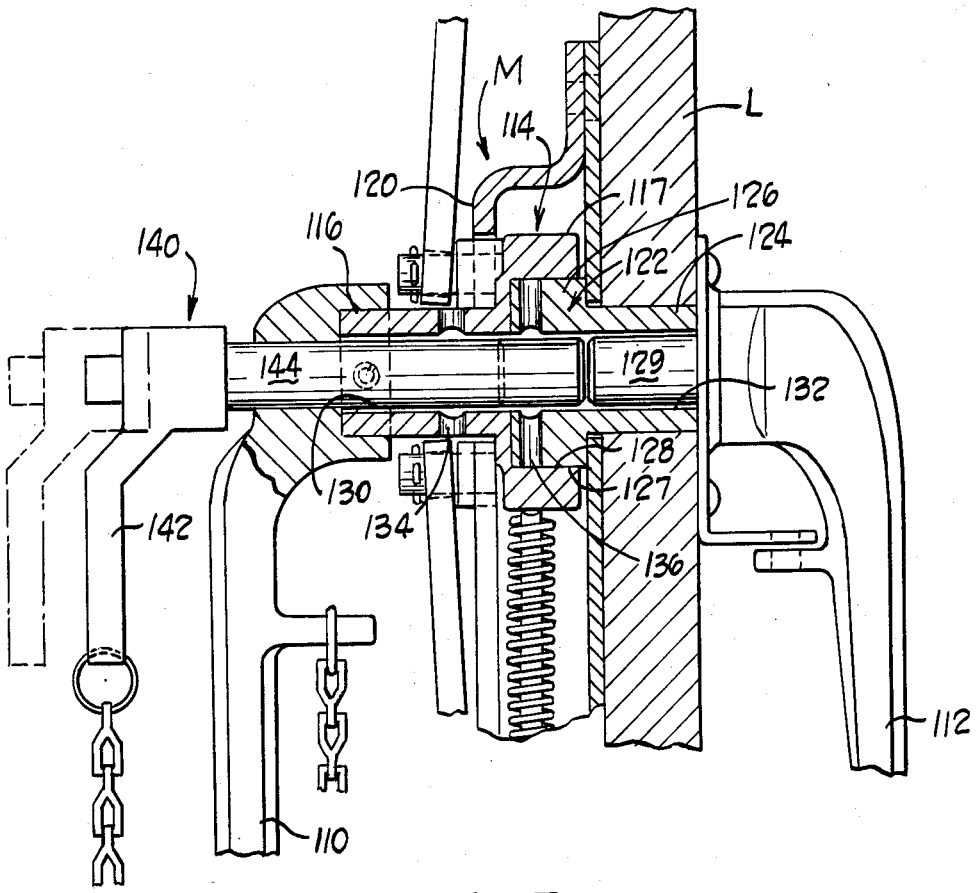
FIG. 3 is a fragmentary view partly in section and partly in elevation showing a modified lock embodying the present invention.
Figure 4:
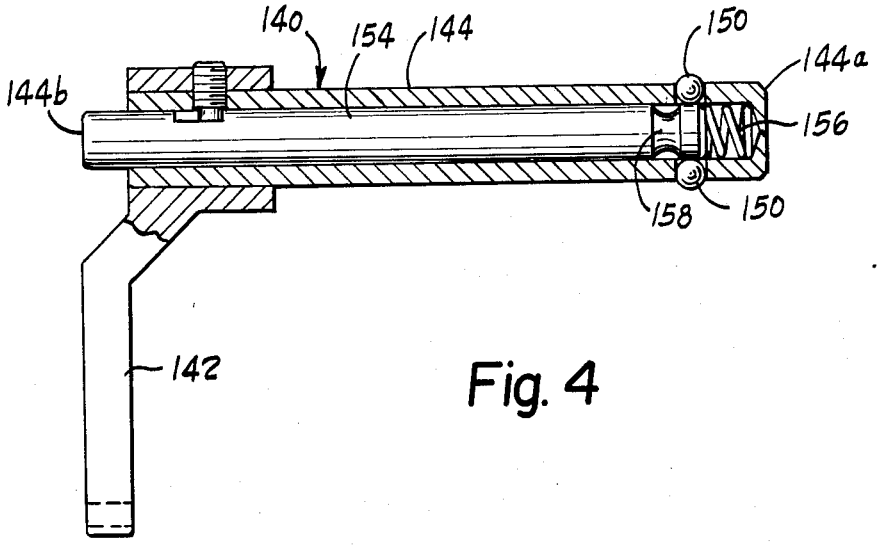
FIG. 4 is a fragmentary view with parts broken away of the embodiment of FIG. 3.

A second embodiment of the invention is shown in FIGS. 3 and 4 of the drawings, constructed to provide handles 110, 112 on two opposite sides of a door L, the handle 110 being on the inside of a closed compartment of a vehicle and the handle 112 on the outside. This construction is useful on vehicles, such as tactical military vehicles, and allows a person within the vehicle to selectively disable the outside handle 112 from inside of the vehicle so the outside handle will not operate the bolts and will not prevent operation of the inside handle. Thus, if the outside handle is padlocked in place the bolts can nevertheless be operated with the inside handle.

A bolt operating assembly M is provided similar to the assembly F, but having a first rotatable member 114 similar to the member 62 but having a hub 116 extending from a larger diameter body portion 117. The member 114 is rotatably received in a frame assembly 120 similar to the frame assembly 64. The hub extends from the frame assembly into the vehicle and supports the inside handle 110, which is pinned to the hub. Rotation of the handle rotates the member 114 to actuate the bolts in the same manner as does the member 62.

The bolt assembly M also has a second rotatable member 122 that has a hub 124 extending from a larger diameter body portion 126. The hub 124 receives a square operative shaft 129 of the handle 112, which is rotatably attached to the outside of the door L. The member 122 is rotatably secured in the frame assembly 120 and has a central axis of rotation in common with a central axis of rotation of the member 114. The body portion 126 has a circular outside periphery 127 rotatably received within a circular counterbored recess 128 in the body portion 117. The members 114 and 122 each have a central through-passage 130, 132, respectively, of substantially square cross-section and aligned. The members also each have a cross bore 134, 136, respectively, for receiving detents that retain a release member 140 in the through passages 130, 132.

The release member 140 has a handle portion 142 adjacent the inside operating handle 110 and a square rod portion 144 extending from the handle portion 142 through the inside handle 110 and, depending upon the position of the release member, into the first rotatable member 114 only (as shown in the phantom position of FIG. 3) or into both the first and second rotatable members 114 and 122 (as shown in solid line). The square rod fits closely within the through passages 130, 132 and therefore is not relatively rotatable with respect to the members 114 and 122 when it extends into the through passages. Thus, when in the solid line position, the rod is rotated by the member 114 when the handle 110 is rotated, thereby rotating the second member 122 and the handle 112. Conversely, rotation of the handle 112 will rotate the member 122, the rod 144, the member 114, which operates the bolts, and the handle 110. When the rod 144 is in the phantom position and not extending into the member 122, rotation of the handle 110 will rotate the member 114 but not the member 122 or the handle 122 nor will the locking of the handle 122 in a fixed position prevent rotation of the member 114 by the handle 110.

The rod 144 has a pair of detents 150 positioned to cooperate with the cross bores 134, 136; i.e., positioned to cooperate with the bores 134 with the end **144*a* withdrawn from the member 122, and with the bores 136 when the end 144*a* extends into the member 122. The detents are ball bearings and are held in a partially extending position from opposite flat surfaces of the rods by a central shaft 154 movable longitudinally within the rod and biased by a compression spring 156 to the position shown in FIG. 4, where an end 144*b* extends beyond the handle portion 142. When the end 144*b* is pressed to move the shaft against the spring bias, a peripheral groove 158 on the shaft is moved into alignment with the detents, allowing them to retract into the rod 144, which can then be moved within the through-passages 130, 132 to one of the two positions shown, where either both members 114 and 122 rotate together or where rotation of one has no effect on the other. When the shaft is released and the detents aligned with the cross bores, the shaft will force the detents into the cross bores to retain the rod 144** in the desired position.

From the foregoing, it will be apparent the objects heretofore enumerated and others have been accomplished and that the present invention provides a novel and improved closure mechanism or lock for doors of highway trucks, military vehicles, and the like, including one or more dead bolts which are easily moved into and out of engagement with their keepers under adverse door closing conditions, and which in one embodiment provides a mechanism for selectively enabling and disabling operation through an outside handle.

While preferred embodiments have been illustrated and described in detail it is to be understood that the invention may be otherwise embodied and it is the intention to cover all adaptations and arrangements thereof which come within the practice of those skilled in the art to which the invention relates and the scope of the appended claims.

I claim:

1. In a closure control mechanism attached adjacent to a free edge of a door swingable into and out of an opening with in a wall, a dead bolt lock assembly including a frame immovably mounted on the door and a pair of dead bolts, each having an end, the dead bolts movable within the frame for extension and retraction of the ends of the dead bolts into and out of engagement with a pair of keeper surfaces located on the wall and extending in the direction of extension and retraction; a first surface on one end of each dead bolt transverse to the direction of movement, angularly oriented for substantially the full thickness of the bolt, facing in the direction of extension, facing in the direction of the door swings when the door is swung out of the opening in the wall, facing the keeper surface when the door is in the opening and when the dead bolt lock assembly is in an extended position and facing the door when the dead bolt lock assembly is in a retracted position; a rotatable member in said one end of each dead bolt engageable with the keeper surface to facilitate both extension and retraction of the bolt relative to the keeper; a second surface at said one end of each dead bolt extending in the direction of bolt movement, facing the keeper surface when the dead bolt lock assembly is in an extended position and facing the door when the dead bolt lock assembly is in a retracted position, said rotatable member extending beyond said second surface in rolling engagement with the door or the keeper surface during extension or retraction of the dead bolts; a manual bolt-operating member rotatably supported in the frame; and a pair of rod members operatively connected to the dead bolts and to the bolt-operating member eccentrically of the axis of rotation thereof to extend and retract the dead bolts concurrently.

2. In a closure control mechanism attached adjacent to a free end edge of a door swingable into and out of an opening within a wall, a dead bolt lock assembly including a frame immovably mounted on the door and a pair of dead bolts, each having an end, the dead bolts movable within the frame for extension and retraction of the ends of the dead bolts into and out of engagement with a pair of keeper surfaces located on the wall and extending in the direction of extension and retraction; a first surface on one end of each dead bolt transverse to the direction of movement, angularly oriented for substantially the full thickness of the bolt, facing in the direction of extension, facing in the direction the door swings when the door is swung out of the opening in the wall, facing the keeper surface when the door is in the opening and when the dead bolt lock assembly is in an extended position and facing the door when the dead bolt lock assembly is in a retracted position; a rotatable member in said one end of each dead bolt engageable with the keeper surface to facilitate both extension and retraction of the bolt relative to the keeper; a second surface at said one end of each dead bolt extending in the direction of bolt movement, facing the keeper surface when the dead bolt lock assembly is in an extended position and facing the door when the dead bolt lock assembly is in a retraction position, said rotatable member extending beyond said second surface in rolling engagement with the door or the keeper surface during extension or retraction of the dead bolts; a manual bolt-operating member rotatably supported in the frame; an overcenter spring biasing the manual bolt-operating member in either of two directions about its axis of rotation; a pair of rod members operatively connected to the dead bolts and to the bolt-operating member eccentrically of the axis of rotation thereto extend and retract the dead bolts concurrently; and means for oscillating the manual bolt-operating member about its axis of rotation to move the ends of the dead bolts into and out of engagement with the keeper surfaces.

3. In a closure control mechanism attached adjacent to a free edge of a door swingable into and out of an opening within a wall, a dead bolt lock assembly including a frame immovably mounted on the door and a pair of dead bolts, each having an end, the dead bolts movable within the frame for extension and retraction of the ends of the dead bolts into and out of engagement with a pair of keeper surfaces located on the wall and extending in the direction of extension and retraction; a first surface on one end of each dead bolt transverse to the direction of movement, angularly oriented for substantially the full thickness of the bolt, facing in the direction of extension, facing in the direction the door swings when the door is swung out of the opening in the wall, facing the keeper surface when the door is in the opening and when the dead bolt lock assembly is in an extended position and facing the door when the dead bolt lock assembly is in a retracted position; a rotatable member in said one end of each dead bolt engageable with the keeper surface to facilitate both extension and retraction of the bolt relative to the keeper; a second surface at said one end of each dead bolt extending in the direction of bolt movement, facing the keeper surface when the dead bolt lock assembly is in an extended position and facing the door when the dead bolt lock assembly is in a retracted position, said rotatable member extending beyond said second surface in rolling engagement with the door or the keeper surface during extension or retraction of the dead bolts; a manual bolt-operating member rotatably supported in the frame; a pair of rod members operatively connected to the dead bolts and to the bolt-operating member eccentrically of the axis of rotation thereof to extend and retract the dead bolts concurrently; manual oscillating means for oscillating said manual bolt-operating member about its axis of rotation to extend and retract the dead bolts into and out of engagement with the keeper surfaces; and extension on the manual bolt-operating member located so that when the dead bolt lock assembly is in an extended position, the extension is normal to the direction of bolt movement and pointing in the direction of the free edge of the door; and a roller on the extension for engagement with a keeper on the wall, said roller having an axis of rotation that intersects the axis of rotation of the manual bolt-operating member.

4. In a closure control mechanism attached adjacent to a free edge of a door swingable into and out of an opening within a wall, a dead bolt lock assembly including a frame immovably mounted on the door and a pair of dead bolts, each having an end, the dead bolts movable within the frame for extension and retraction of the ends of the dead bolts into and out of engagement with a pair of keeper surfaces located on the wall and extending in the direction of extension and retraction; a first surface on oen end of each dead bolt transverse to the direction of movement, angularly oriented for substantially the full thickness of the bolt, facing in the direction of extension, facing in the direction the door swings when the door is swung out of the opening in the wall, facing the keeper surface when the door is in the opening and when the dead bolt lock assembly is in an extended position and facing the door when the dead bolt lock assembly is in a retracted position; a rotatable member in said one end of each dead bolt engageable with the keeper surface to facilitate both extension and retraction of the bolt relative to the keeper; a second surface at said one end of each dead bolt extending in the direction of bolt movement, facing the keeper surface when the dead bolt lock assembly is in an extended position and facing the door when the dead bolt lock assembly is in a retraction position, said rotatable member extending beyond said second surface in rolling engagement with the door or the keeper surface during extension or retraction of the dead bolts; a manual bolt-operating member rotatably supported in the frame; an overcenter spring biasing the manual bolt-operating member in either of two directions about its axis of rotation; a pair of rod members operatively connected to the dead bolts and to the bolt-operating member eccentrically of the axis of rotation thereof to extend and retract the dead bolts concurrently; means for oscillating the manual bolt-operating member about its axis of rotation to move the ends of the dead bolts into and out of engagement with the keeper surface; an extension on said manual bolt-operating member located so that when the dead bolt lock assembly is in an extended position, the extension is normal to the direction of bolt movement and pointing in the direction of the free edge of the door; and a roller on the extension for engagement with a keeper on the wall, said roller having an axis of rotation that intersects the axis of rotation of the manual bolt operating member.

5. An assembly as set forth in calims 1, 2, 3 or 4 wherein the manual bolt-operating member has a face with a circular recess concentric with its rotary axis and is rotatable by a first handle on one side of the door and selectively by a second handle on the opposite side of the door, wherein a rod is movable from said one side of the door through said operating member along the rotary axis to selectively enable or disable the handle on said opposite side of the door, said second handle secured to a rotary member coaxial with the bolt-operating member, said rotary member has a cylindrical portion received in said recess, said rotary member and bolt-operating member are rotatable relative to each other and each has a central aligned aperture for receiving said rod, the apertures and rod being constructed to permit relative movement of the rod longitudinally but not rotationally with respect to the bolt-operating member and rotary member, and means to positively locate and retain said rod in either of two longitudinal positions, one where it is received in the central aperture of the bolt-operating member but not in the central aperture of said rotary merber, and another where it is received in both central apertures.

6. In a close control mechanism attached adjacent to a free edge of a door swingable into and out of an opening within a wall, a dead bolt lock assembly including a frame immovably mounted on the door and a pair of dead bolts, each having an end, the dead bolts movable within the frame for extension and retraction of the ends of the dead bolts into and out of engagement with a pair of keeper surfaces located on the wall and extending in the direction of extension and retraction; a first surface on one end of each dead bolt transverse to the direction of movement, angularly oriented for substantially the full thickness of the bolt, facing in the direction of extension, facing in the direction the door swings when the door is swung out of the openings in the wall, facing the keeper surface when the door is in the opening and when the dead bolt lock assembly is in an extended position and facing the door when the dead bolt lock assembly is in a retracted position; a rotatable member in said one end of each dead bolt engageable with the keeper surface to facilitate both extension and retraction of the bolt relative to the keeper, a second surface at said one end of each dead bolt extending in the direction of bolt movement, facing the keeper surface when the dead bolt lock assembly is in an extended position and facing the door when the dead bolt lock assembly is in a retraction position, said rotatable member extending beyond said second surface in rolling engagement with the door or the keeper surface during extension or retraction of the dead bolts; a manual bolt-operating member rotatably supported in the frame; a pair of rod members operatively connected to the dead bolts and to the bolt-operating member eccentrically of the axis of rotation thereof to extend and retract the dead bolts concurrently; said manual bolt-operating member having a face with a circular recess concentric with its rotary axis and being rotatable by a first handle on one side of the door and selectively by a second handle on the opposite side of the door, wherein a rod is movable from said one side of the door through said operating member along the rotary axis to selectively enable or disable the handle on said opposite side of the door, said second handle secured to a rotary member coaxial with the bolt-operating member, said rotary member having a cylindrical portion received in said recess, said rotary member and bolt-operating member being rotatable relative to each other and each having a central aligned aperture for receiving said rod, the apertures and rod being constructed to permit relative movement of the rod longitudinally but not rotationally with respect to the bolt-operating member and rotary member, and means to positively locate and retain said rod in either of two longitudinally positions, one where it is received in the central aperture of the bolt-operating member but not in the central aperture of said rotary member, and another where it is received in both central apertures.

* * * * *

UNITED STATES PATENT AND TRADEMARK OFFICE

CERTIFICATE OF CORRECTION

PATENT NO. : 4,641,865

DATED : February 10, 1987

INVENTOR(S) : John V. Pastva

It is certified that error appears in the above-identified patent and that said Letters Patent is hereby corrected as shown below:

Column 6, line 21 (claim 1), "with in" should be --within--;
line 31 (claim 1), delete "of" (second occurrence);
line 54 (claim 2), delete "end".

Column 7, line 19 (claim 2), "thereto" should be --thereof to--;
line 60 (claim 3), "and" (second occurrence) should be --an--.

Column 8, line 10 (claim 4), "oen" should be --one--.

Column 9, line 1 (claim 5), "merber" should be --member--;
line 3 (claim 6), "close" should be --closure--;
line 16 (claim 6), "openings" should be --opening--.

Column 10, line 25 (claim 6), "longitudinally" should be --longitudinal--.

Signed and Sealed this

First Day of December, 1987

*Attest:*

*Attesting Officer*

DONALD J. QUIGG

*Commissioner of Patents and Trademarks*